US009078538B2

(12) United States Patent
Sickels et al.

(10) Patent No.: US 9,078,538 B2
(45) Date of Patent: Jul. 14, 2015

(54) FABRIC HANGING AND PLEATING APPARATUS

(71) Applicant: Soundfold Inc., Centerville, OH (US)

(72) Inventors: Anthony R. Sickels, Springboro, OH (US); Michael S. Sickels, Waynesville, OH (US)

(73) Assignee: Soundfold, Inc., Centerville, OH (US)

( * ) Notice: Subject to any disclaimer, the term of this patent is extended or adjusted under 35 U.S.C. 154(b) by 0 days.

(21) Appl. No.: 14/066,972

(22) Filed: Oct. 30, 2013

(65) Prior Publication Data

US 2014/0124148 A1 May 8, 2014

Related U.S. Application Data

(60) Provisional application No. 61/722,470, filed on Nov. 5, 2012.

(51) Int. Cl.
*A47H 13/16* (2006.01)
*A47H 1/18* (2006.01)

(52) U.S. Cl.
CPC . *A47H 1/18* (2013.01); *A47H 13/16* (2013.01)

(58) Field of Classification Search
USPC ..... 160/327, 328, 39, 38, 348, 398, 404; 52/222
IPC ..... A47H 13/16
See application file for complete search history.

(56) References Cited

U.S. PATENT DOCUMENTS

| | | | | |
|---|---|---|---|---|
| 1,085,948 | A | | 2/1914 | Smith |
| 1,504,810 | A | | 8/1924 | Byron |
| 1,991,156 | A | | 2/1935 | Kahn et al. |
| 2,126,834 | A | | 8/1938 | Steinberger |
| 2,144,513 | A | | 1/1939 | Smith |
| 2,522,358 | A | | 9/1950 | Franson et al. |
| 2,557,578 | A | * | 6/1951 | Stallone ..... 160/348 |
| 2,724,434 | A | | 11/1955 | Smith |
| 2,821,237 | A | | 1/1958 | Howard |
| 3,011,174 | A | | 12/1961 | Schaerer |
| 3,185,207 | A | * | 5/1965 | Humble ..... 160/382 |
| 3,338,292 | A | | 8/1967 | Goodman |
| 3,399,713 | A | | 9/1968 | Wilson |
| 3,683,994 | A | * | 8/1972 | Eichenlaub ..... 160/327 |
| 3,785,426 | A | * | 1/1974 | Sperling ..... 160/327 |
| 3,896,931 | A | | 7/1975 | Franklin |
| 3,998,015 | A | | 12/1976 | Scott et al. |
| 3,999,590 | A | | 12/1976 | Koch |
| 4,055,211 | A | * | 10/1977 | Sperling ..... 160/327 |
| 4,058,946 | A | | 11/1977 | Habrant |
| 4,079,682 | A | | 3/1978 | Nishiwaki |
| 4,093,483 | A | | 6/1978 | Jacobs |
| 4,117,180 | A | | 9/1978 | DeWoskin |
| 4,152,809 | A | | 5/1979 | Wertepny |

(Continued)

FOREIGN PATENT DOCUMENTS

| | | |
|---|---|---|
| EP | 412081 | 12/1994 |

*Primary Examiner* — David Purol

(74) *Attorney, Agent, or Firm* — Faegre Baker Daniels LLP

(57) ABSTRACT

A pleated wall covering system includes a bracket for hanging and pleating wall fabric. The bracket includes a plurality of longitudinally extending planar mounting portions and a plurality of longitudinally spaced u-shaped pleating portions interspaced between the mounting portions. In an illustrative embodiment, a receiver includes opposing upper and lower slots configured to receive the mounting portions of the bracket.

6 Claims, 6 Drawing Sheets

(56) References Cited

U.S. PATENT DOCUMENTS

| | | | | |
|---|---|---|---|---|
| 4,226,276 | A | 10/1980 | Bressler | |
| 4,230,171 | A | 10/1980 | Baker | |
| 4,284,215 | A | 8/1981 | Nye | |
| 4,342,356 | A * | 8/1982 | Sickels et al. | 160/348 |
| 4,605,088 | A | 8/1986 | Sickels | |
| 4,858,668 | A | 8/1989 | Toti | |
| 4,878,531 | A | 11/1989 | Stover | |
| 4,915,153 | A | 4/1990 | Toti | |
| 5,042,548 | A * | 8/1991 | Attal | 160/38 |
| 5,043,038 | A | 8/1991 | Colson | |
| 5,114,056 | A | 5/1992 | Frye | |
| 5,323,834 | A | 6/1994 | Toti | |
| 5,343,925 | A | 9/1994 | Hannerstig | |
| 6,094,796 | A * | 8/2000 | Biro | 29/463 |
| 6,336,493 | B1 | 1/2002 | Sickels | |

* cited by examiner

FABRIC HANGING AND PLEATING APPARATUS

CROSS-REFERENCE TO RELATED APPLICATION

This application claims priority to U.S. Provisional Patent Application Ser. No. 61/722,470, filed Nov. 5, 2012, the disclosure of which is expressly incorporated herein by reference.

BACKGROUND AND SUMMARY

The present invention relates to wall coverings and, more particularly, to an apparatus for use in hanging and pleating wall fabrics.

Devices have been proposed for hanging large sections of fabrics for both decorative and acoustical (reverb) purposes along the walls of theaters, concert halls and the like. Typically, such devices include hanging brackets including pleat forming bends at equally spaced intervals wherein a planar fabric material is wrapped around the bracket bends during installation to produce a pleated appearance to the installed fabric. Examples of such pleating brackets and methods of installation are disclosed in U.S. Pat. Nos. 3,785,426 and 4,342,356, both of which are incorporated herein by reference.

According to an illustrative embodiment of the present disclosure, a bracket for hanging and pleating wall fabric includes a plurality of longitudinally extending planar mounting portions configured to be positioned adjacent a vertical wall. Each of the mounting portions includes a plurality of mounting apertures for receiving fasteners to couple the mounting portions to the vertical wall. The bracket further includes a plurality of longitudinally spaced u-shaped pleating portions. Each pleating portion extends laterally intermediate adjacent mounting portions. Each of the pleating portions includes an upwardly extending pointed tab configured to engage wall fabric. The plurality of mounting portions and the plurality of pleating portions are integrally formed of a polymer.

According to another illustrative embodiment of the present disclosure, a bracket for hanging and pleating wall fabric includes a plurality of longitudinally extending planar mounting portions configured to be positioned adjacent a vertical wall, each of the mounting portions including a plurality of mounting apertures for receiving fasteners to couple the mounting portions to the vertical wall. The mounting portions each include an upper edge and a clearance recess extending downwardly from the upper edge for receiving fasteners for securing the wall fabric to the vertical wall. Upper mounting tabs extend upwardly at opposing ends of the clearance recess. The bracket further includes a plurality of longitudinally spaced u-shaped pleating portions, each pleating portion extending laterally intermediate adjacent mounting portions. Each of the pleating portions includes laterally spaced first and second side walls, and an end wall connecting the first wall and the second wall. The end wall defines an upper shelf supporting an upwardly extending pointed tab configured to engage wall fabric. Clearance slots are positioned intermediate the first and second side walls and the pointed tab. The bracket further includes a plurality of longitudinally spaced connecting webs, each connecting web extending between one of the mounting portions and one of the pleating portions. Upper and lower clearance slots extend laterally intermediate the mounting portions and the pleating portions above and below the connecting webs. The plurality of mounting portions, pleating portions and connecting webs are integrally formed of a polymer.

According to a further illustrative embodiment of the present disclosure, a pleated wall covering system includes a receiver having a body portion with a rear wall configured to be mounted to the vertical wall. An upper slot is supported by the rear wall and is positioned laterally forward of the rear wall, and a lower slot is supported by the rear wall below the upper slot and positioned laterally forward of the rear wall in alignment with the upper slot. A bracket includes a plurality of longitudinally extending planar mounting portions configured to be positioned within the upper and lower slots of the receiver. The bracket further includes a plurality of longitudinally spaced u-shaped pleating portions. Each pleating portion extends laterally intermediate adjacent mounting portions and includes an upwardly extending pointed tab configured to engage wall fabric.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 3:
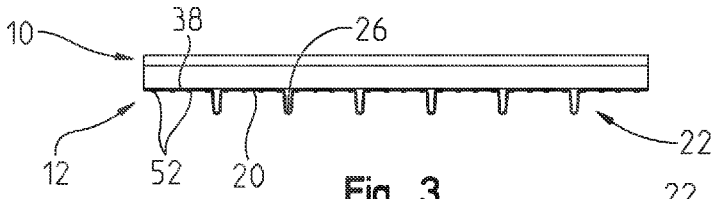
FIG. 3 is a top plan view of the wall covering system of FIG. 1.
Figure 2:
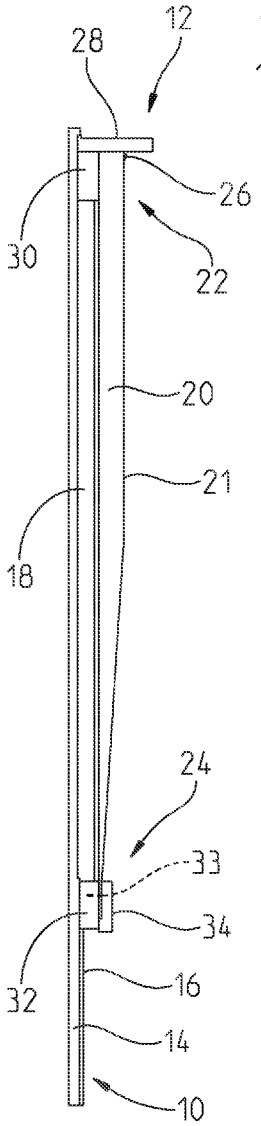
FIG. 2 is a side elevational view of the wall covering system of FIG. 1.
Figure 1:
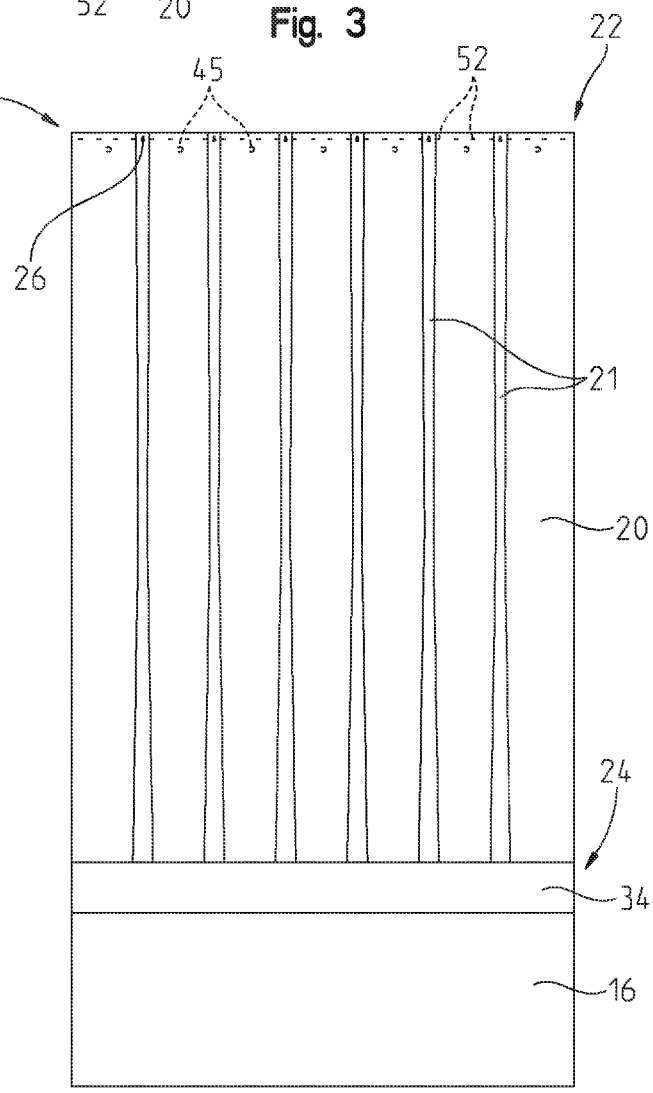
FIG. 1 is a front elevational view of an illustrative wall covering system of the present disclosure.

Referring initially to FIGS. 1-3, a vertical support or wall 10 supporting an illustrative acoustical wall covering system 12 of the present disclosure is shown. In the illustrative embodiment, the wall 10 includes a drywall portion 14 with a lower section covered with wall carpet 16. Illustratively, sound insulation 18 extends above the wall carpet 16. The sound insulation 18 may comprise a semi-rigid one inch thick insulation board. The upper portion of the wall 10, including the sound insulation 18, is covered by flexible material, illustratively acoustical fabric 20 including a plurality of laterally spaced, longitudinally extending pleats 21.

The fabric 20 illustratively extends between upper and lower mounting assemblies 22 and 24 which are secured to the wall 10. The upper mounting assembly 22 includes a pleating bracket 26 positioned proximate the ceiling 28 and configured to pleat and secure an upper end of the fabric 20.

As further detailed herein, the pleating bracket 26 is supported by a header 30, illustratively a 2×4 wood nailer. A lower end of the fabric 20 is supported by a footer 32, illustrative a 2×4 wood nailer. More particularly, the lower end of the fabric 20 may be directly secured to the footer 32 through conventional fasteners 33, such as nails or staples. Finish trim 34 may cover the fasteners 33 and the lower end of the fabric 20.

Figure 4:
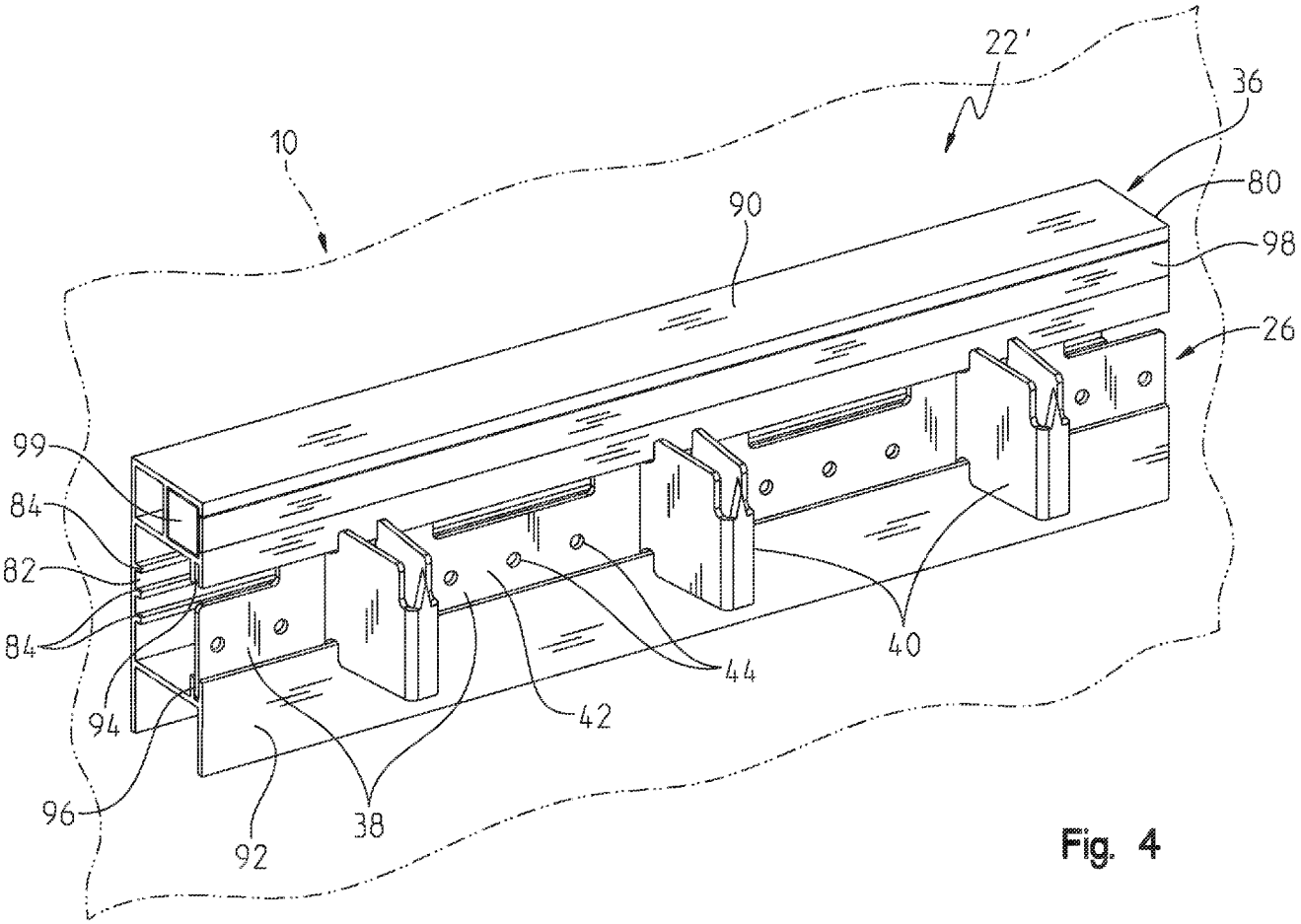
FIG. 4 is an illustrative upper mounting apparatus for use with a wall covering system.
Figure 5:
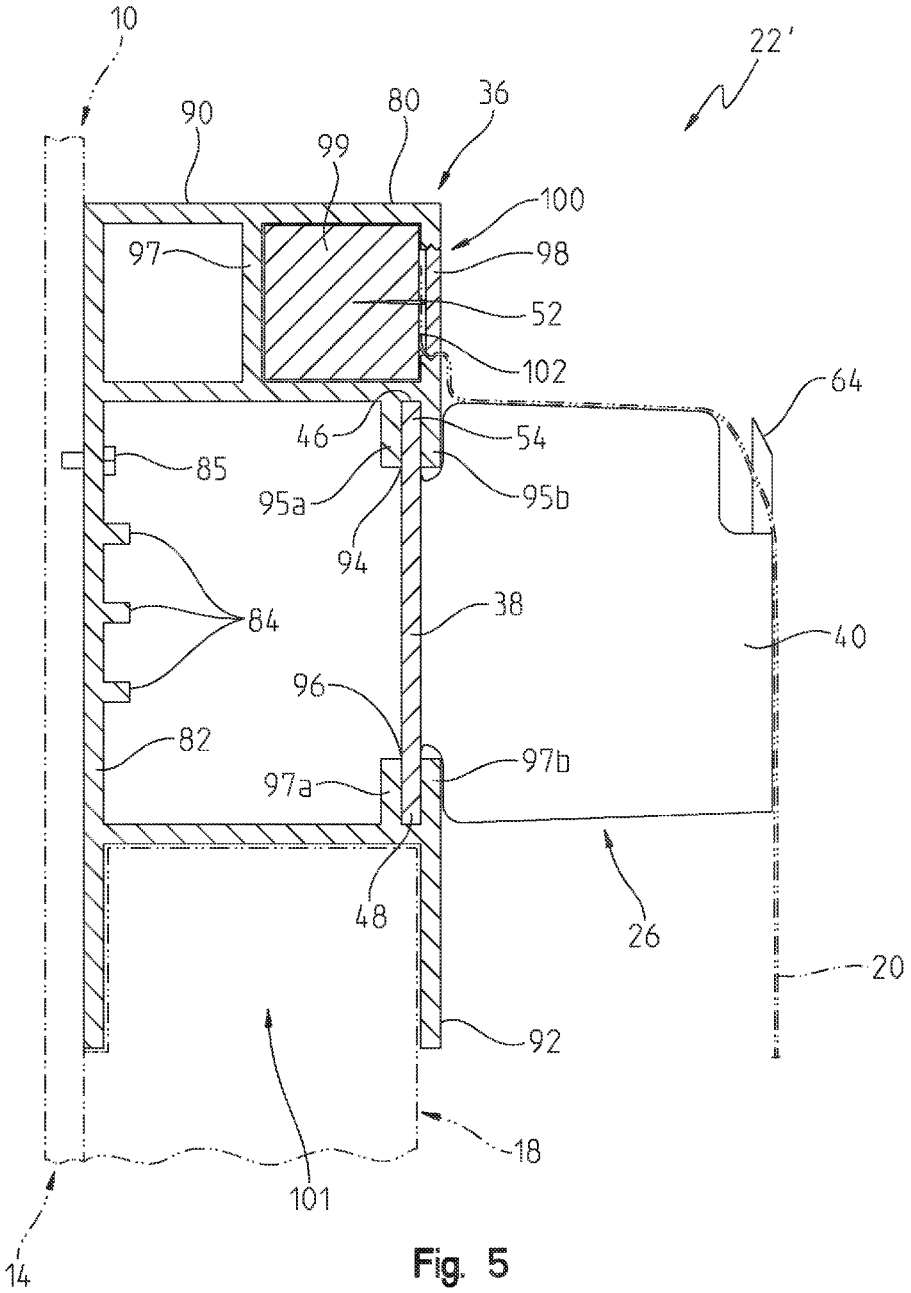
FIG. 5 is a cross-sectional view of the upper mounting apparatus of FIG. 4.
Figure 6:
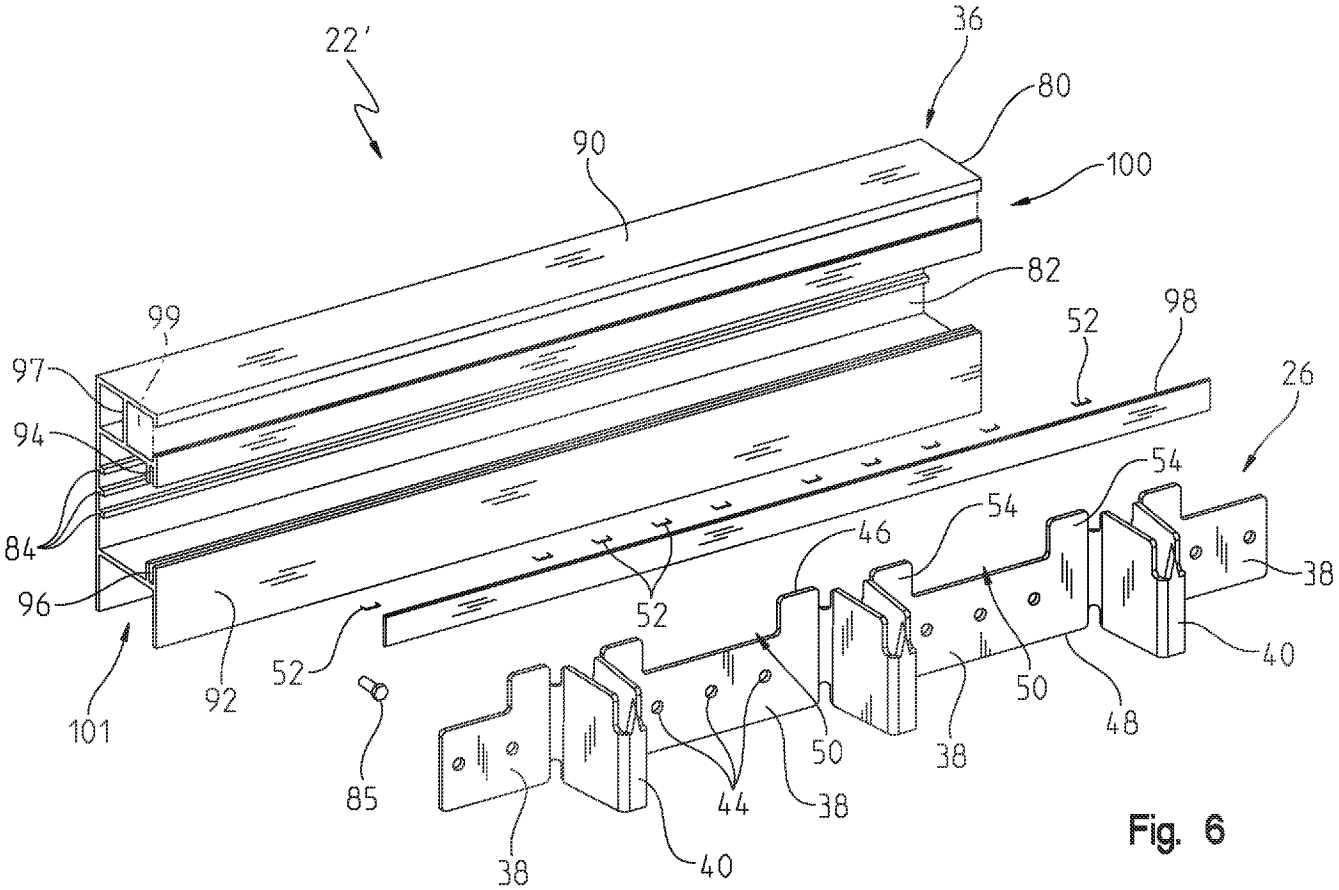
FIG. 6 is an exploded perspective view of the upper mounting apparatus of FIG. 4.

With reference to FIGS. 1-3, the illustrative upper mounting assembly 22 includes bracket 26 secured directly to the wall 10. An alternative upper mounting assembly 22' is shown in FIGS. 4-6 as including bracket 26 removably coupled to a receiver 36. The bracket 26 illustratively includes a plurality of longitudinally extending planar mounting portions 38 and a plurality of longitudinally spaced u-shaped pleating portions 40. Each pleating portion 40 extends laterally intermediate adjacent mounting portions 38.

Each illustrative mounting portion 38 includes a planar body 42 having a plurality of mounting apertures or openings 44 which may be utilized to secure the bracket 26 directly to the header 30 through fasteners 45, such as nails or screws (FIG. 1). The body 42 of each mounting portion 38 includes an upper edge 46 and a lower edge 48. A clearance recess 50 extends downwardly from the upper edge 46 which reduces the amount of material required for the bracket 26 and may receive fasteners 52, such as nails or staples, for securing wall fabric 20 directly to the header 30. Upper mounting tabs 54 extend upwardly at opposing ends of each clearance recess 50 (FIG. 6). The bracket 26 defines a form for a user securing the wall fabric 20 to the header 30. In the illustrative embodiment, four staples 52 are received between each pleating portion 40 of the bracket 26, including one staple 52 against each side of adjacent pleats 21 and two staples 52 positioned therebetween. It should be appreciated that the number and placement of fasteners 52 may vary.

Figure 7:
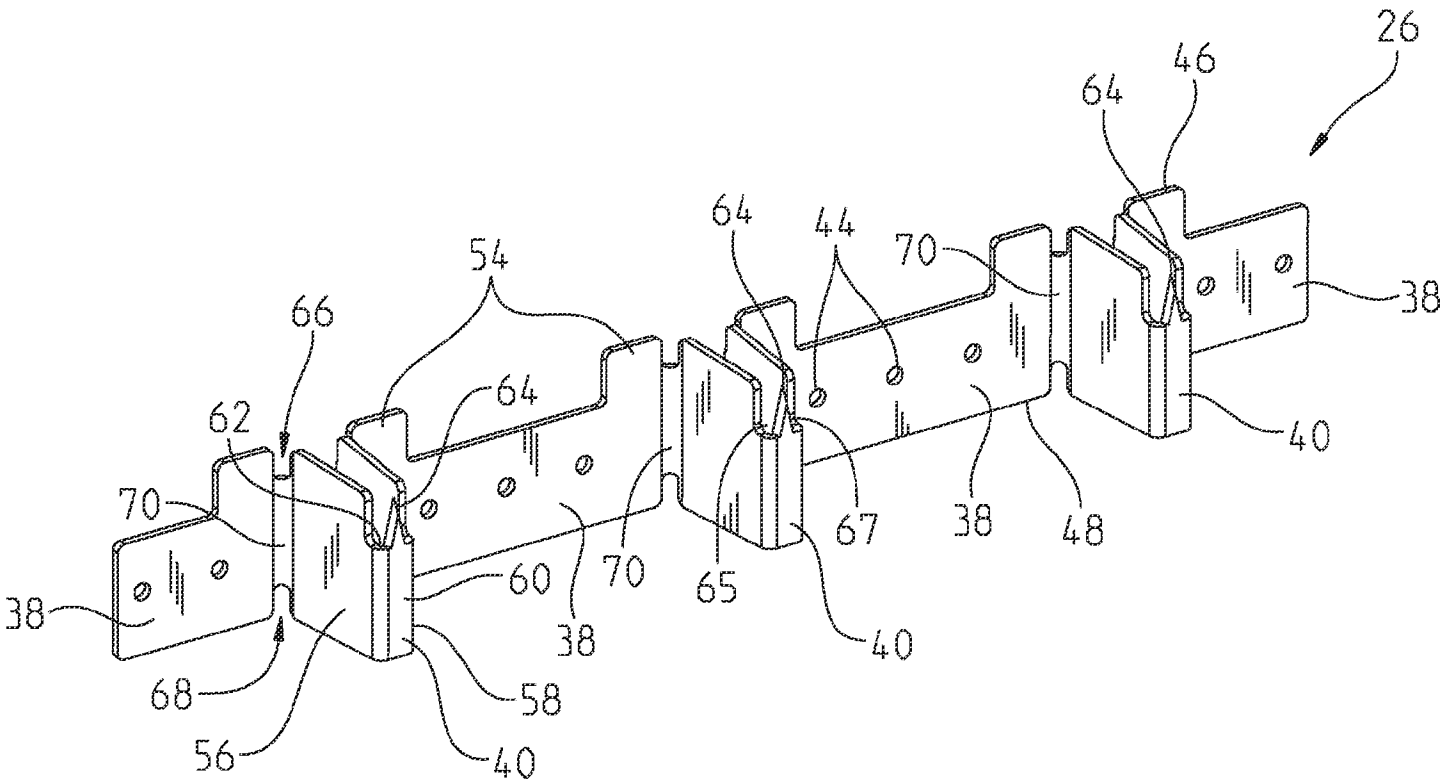
FIG. 7 is a perspective view of the mounting bracket of FIG. 4.
Figure 8:
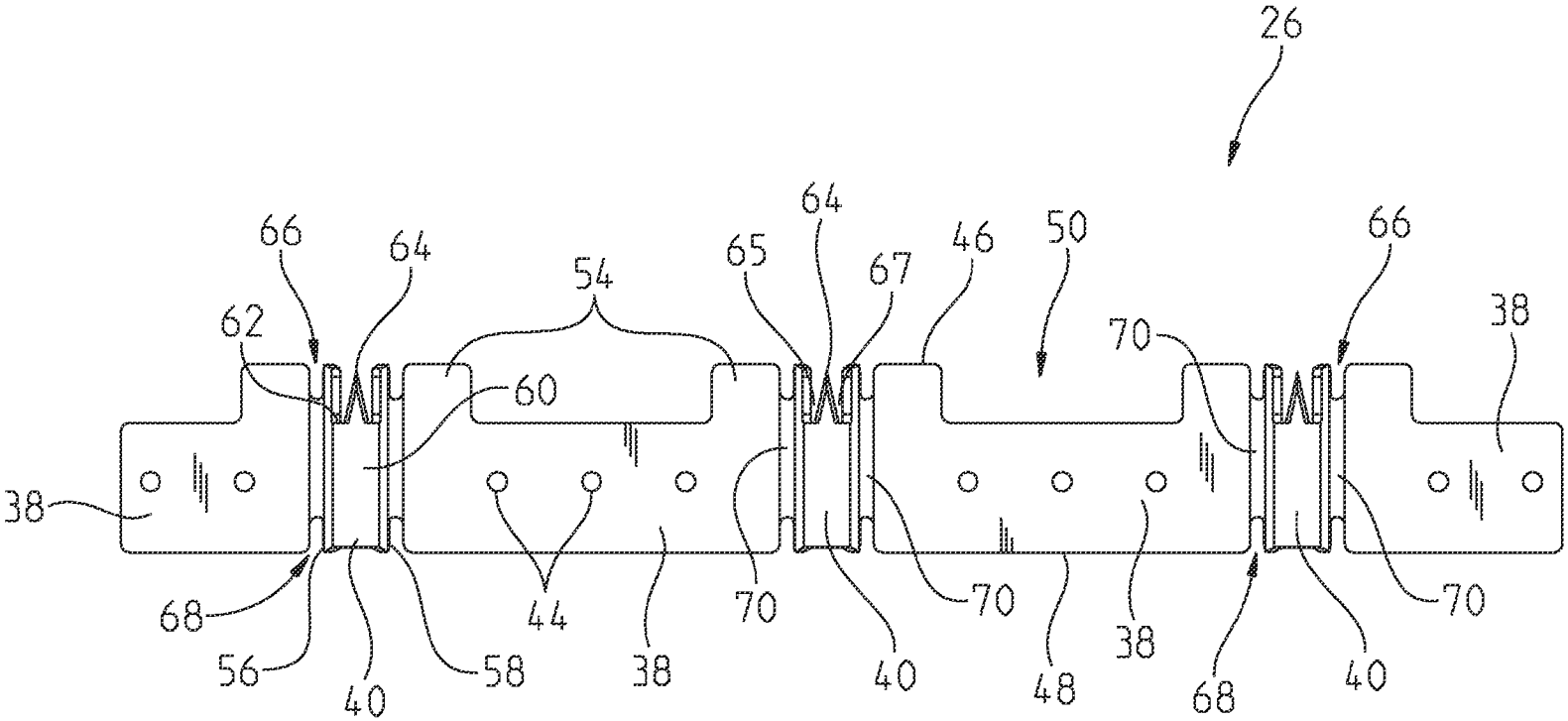
FIG. 8 is a front elevational view of the mounting bracket of FIG. 7.

With reference to FIGS. 7 and 8, each pleating portion 40 includes laterally spaced first and second side walls 56 and 58, and an end wall 60 connecting the first wall 56 and the second wall 58. The end wall 60 defines an upper shelf or platform 62 supporting an upwardly extending pointed projection or tab 64 configured to engage wall fabric 20. Clearance slots 65 and 67 are positioned intermediate the first and second side walls 56 and 58 and the pointed tab 64, respectively.

The bracket 26 further includes a plurality of longitudinally spaced connecting webs 70 extending between adjacent mounting and pleating portions 38 and 40. Upper and lower clearance slots 66 and 68 extend laterally intermediate the mounting portions 38 and the pleating portions 40, above and below the connecting webs 70.

In the illustrative embodiment, the bracket 26 is formed of a polymer. More particularly, in one illustrative embodiment, the mounting portions 38, the pleating portions 40, and the connecting webs 70 may be integrally injection molded from acrylonitrile butadiene styrene (ABS). Illustratively, the ABS of bracket 26 is fire resistant and may be black or of a color similar to that of the fabric 20 such that it is not clearly visible to a ground based observer.

In the illustrative upper mounting assembly 22' of FIGS. 4-6, the receiver 36 includes a body portion 80 having a rear wall 82 configured to be mounted to the vertical wall 10. A plurality of strengthening ribs 84 are illustratively supported by the rear wall 82. A plurality of mounting apertures or openings (not shown) may be formed within the rear wall 82 and are configured to receive fasteners 85, such as screws, to secure the receiver 36 to the header 30. The receiver 36 further includes an upper support 90 secured to the upper end of the rear wall 82, and a lower support 92 secured to a lower end of the rear wall 82. An upper slot 94 is supported by the upper support 90 and is positioned laterally forward of the rear wall 82. The upper slot 94 is defined by a pair of opposing walls 95*a*, 95*b*. A lower slot 96 is supported by the lower support 92 and extends below the upper slot 94. The lower slot 96 is defined by a pair of opposing walls 97*a*, 97*b* and is illustratively positioned laterally forward of the rear wall 82 in alignment with the upper slot 94.

The bracket 26 is illustratively received intermediate the upper and lower slots 94 and 96 of the receiver 36. More particularly, the mounting tabs 54 of the mounting portions 38 are slidably received within the upper slot 94, while the lower edges 48 of the mounting portions 38 are slidably received within the lower slot 96. The clearance slots 66 and 68 receive outer walls 95*b* and 97*b* of the receiver 36.

An insert or mounting strip 98 is supported by the upper support 90 of the receiver 36. In one illustrative embodiment, the mounting strip 98 defines a door or panel removably received within an access opening 100 in the upper support 90 of the receiver 36. The mounting strip 98 is illustratively formed of a material softer than the material of the body portion 80 of the receiver 36. In one illustrative embodiment, the body portion 80 of the receiver 36 is formed of ABS, while the mounting strip 98 is formed of a polypropylene. The softer material of the mounting strip 98 may be used to facilitate insertion of fasteners 52, such as nails or staples, to secure the fabric 20 thereto. The body portion 80 and the mounting strip 98 may be formed from conventional manufacturing processes, illustratively through extrusion.

The upper support 90 of receiver 36 may include an intermediate vertical wall 97 for added structural support. Illustratively, a fastener insert 99 is received with an outwardly facing cavity defined between wall 97 and opening 100. The fastener insert 99 is illustratively formed of a material (e.g., plastic or wood) configured to receive fasteners 52, such as staples or nails. The lower support 92 of the receiver 36 may include a downwardly facing opening 101 configured to receive an upper end of sound insulation 18 therein.

As shown in the illustrative embodiment of FIG. 5, the fabric 20 is wrapped around the pleating portions 40 of the brackets 26 and secured on upwardly extending tabs 64. The upper end of the fabric 20 may be secured to a front surface 102 of the fastener insert 99 through fasteners 52, such as nails or staples. The mounting strip 98 is then secured in place, illustratively in a tongue-in-groove type manner, to the upper support 90 of the receiver 36 within access opening 100 to cover the fasteners 52 and provide a finished appearance. The fabric 20 is thereby trapped between the lower end of the mounting strip 98 and the receiver 36.

As noted above, in certain illustrative embodiments, the bracket 26 may be secured directly to the header 30 through fasteners 52 without the use of the receiver 36. In other embodiments, the bracket 26 is removably supported within the receiver 36 which, in turn, is secured to the header 30 through fasteners 45.

To install the illustrative system 12 of the present disclosure, the mounting portions 38 of each bracket 26 may be coupled to the header 30 of the wall 10 directly through fasteners 45. In alternative embodiments, the brackets 26 are removably supported within receivers 36 through sliding receipt within slots 94 and 96.

After the bracket 26 has been installed on the wall 10, either directly to the header 30, or through sliding receipt within the receiver 36 which is secured to the header 30, fabric 20 is hung and pleated. More particularly, the fabric 20 is wrapped around the side walls 56, 58 and end walls 60 of the pleating portions 40 and then secured to the tabs 64. The upper end of the fabric 20 is then either secured directly to the header 30 by fasteners 52 received within recesses 50 of the bracket 26, or by fasteners 52 received within the fastener insert 99 of the receiver 36 and covered by mounting strip 98. As detailed above, the bracket 26 defines a form for the fasteners 52 to aid the installer in securing the fabric 20 to the header 30. The lower end of the fabric 20 is then secured to the footer 32 and covered by trim 34.

The bracket 26 of the present disclosure assists in efficient, safe and reliable installation of aesthetically pleasing wall covering systems 12. More particularly, the bracket 26 defines a fastener form, is light-weight and easy to handle, and has hooks not visible to the typical observer.

Although the invention has been described in detail with reference to certain preferred embodiments, variations and modifications exist within the spirit and scope of the invention as described and defined in the following claims.

The invention claimed is:

1. A pleated wall covering system comprising:

a receiver including a body portion having a rear wall configured to be mounted to a vertical wall, an upper slot supported by the rear wall and positioned laterally forward of the rear wall, and a lower slot supported by the rear wall below the upper slot and positioned laterally forward of the rear wall in alignment with the upper slot;

a bracket including a plurality of longitudinally extending planar mounting portions configured to be positioned within the upper and lower slots of the receiver, and a plurality of longitudinally spaced U-shaped pleating portions, each pleating portion extending laterally intermediate adjacent mounting portions, and including an upwardly extending pointed tab configured to engage wall fabric;

a mounting strip removably supported by the receiver above the upper slot;

wherein the mounting strip covers a chamber configured to receive the upper end of the wall fabric; and a fastener insert received within the chamber and configured to receive fasteners to secure the wall fabric to the receiver.

2. The pleating wall covering system of claim 1, wherein the mounting strip is formed of a material softer than the material of the body portion of the receiver.

3. The pleating wall covering system of claim 1, wherein the receiver includes a lower cavity to receive an upper portion of the vertical wall.

4. The pleating wall covering system of claim 1, wherein the plurality of mounting portions and the plurality of pleating portions of the bracket are integrally formed of a polymer.

5. The pleating wall covering system of claim 4, wherein the plurality of mounting portions and the plurality of pleating portions are molded from acrylonitrile butadiene styrene.

6. The pleating wall covering system of claim 1, wherein each of the mounting portions includes an upper edge and a clearance recess extending downwardly from the upper edge for receiving fasteners to secure the fabric.

* * * * *